US008910494B2

(12) United States Patent
Kahlert

(10) Patent No.: US 8,910,494 B2
(45) Date of Patent: Dec. 16, 2014

(54) CONTAINER WITH FLEXIBLE WALLS

(75) Inventor: Wolfgang Kahlert, Koerle (DE)

(73) Assignee: Sartorius Stedim Biotech GmbH, Goettingen (DE)

( * ) Notice: Subject to any disclaimer, the term of this patent is extended or adjusted under 35 U.S.C. 154(b) by 1078 days.

(21) Appl. No.: 12/745,024

(22) PCT Filed: Nov. 20, 2008

(86) PCT No.: PCT/EP2008/009808

§ 371 (c)(1),
(2), (4) Date: May 27, 2010

(87) PCT Pub. No.: WO2009/074213

PCT Pub. Date: Jun. 18, 2009

(65) Prior Publication Data

US 2010/0301042 A1 Dec. 2, 2010

(30) Foreign Application Priority Data

Dec. 12, 2007 (DE) ..... 10 2007 060 291

(51) Int. Cl.

| | |
|---|---|
| ***F25D 11/04*** | (2006.01) |
| ***B01F 15/00*** | (2006.01) |
| ***B01F 7/18*** | (2006.01) |
| ***B01F 15/06*** | (2006.01) |

(52) U.S. Cl.

CPC ..... *B01F 15/00883* (2013.01); *B01F 15/0085* (2013.01); *B01F 7/18* (2013.01); *B01F 15/00831* (2013.01); *B01F 15/065* (2013.01)

USPC ..... 62/451

(58) Field of Classification Search

CPC ..... B01F 15/00831; B01F 15/0085; B01F 15/00883; B01F 15/065; B01F 11/04; B01F 2215/0032; B01F 7/16

USPC ..... 62/440, 451, 187, 156; 165/109

See application file for complete search history.

(56) References Cited

U.S. PATENT DOCUMENTS

| | | | | |
|---|---|---|---|---|
| 2,797,903 | A * | 7/1957 | Urban | 366/302 |
| 3,978,918 | A * | 9/1976 | Nagatomo et al. | 165/109.1 |
| 4,670,397 | A * | 6/1987 | Wegner et al. | 435/289.1 |
| 4,918,927 | A * | 4/1990 | Eigenbrod | 62/45.1 |

(Continued)

FOREIGN PATENT DOCUMENTS

| | | | | |
|---|---|---|---|---|
| CN | 101071046 | A * | 11/2007 | F28D 1/03 |
| DE | 297 93 244 | | 7/1998 | |

(Continued)

OTHER PUBLICATIONS

International Preliminary Report on Patentability, May 27, 2010.

*Primary Examiner* — Frantz Jules
*Assistant Examiner* — Emmanuel Duke
(74) *Attorney, Agent, or Firm* — Gerald E. Hespos; Michael J. Porco; Matthew T. Hespos

(57) ABSTRACT

A container arrangement has a container with a flexible wall. The container may be a disposable container and is insertable into a supporting container so that an inner supporting surface of the supporting container surrounds and supports a lateral wall of the container. At least one baffle that has a temperature-regulating system is disposed in proximity to the lateral wall of the container and/or the supporting surface of the supporting container.

10 Claims, 5 Drawing Sheets

(56) References Cited

U.S. PATENT DOCUMENTS

| | | | | |
|---|---|---|---|---|
| 5,357,758 | A * | 10/1994 | Andonian | 62/45.1 |
| 5,368,786 | A * | 11/1994 | Dinauer et al. | 261/130 |
| 5,697,435 | A * | 12/1997 | Stickford et al. | 165/146 |
| 5,992,157 | A | 11/1999 | Gerhard | |
| 6,230,516 | B1 * | 5/2001 | Andonian | 62/461 |
| 6,837,610 | B2 | 1/2005 | Cadogan et al. | |
| 2006/0013749 | A1 * | 1/2006 | Arencibia | 422/202 |
| 2006/0163260 | A1 | 7/2006 | Schmidt | |
| 2007/0023173 | A1 * | 2/2007 | Nelson et al. | 165/161 |
| 2009/0314666 | A1 | 12/2009 | Reif et al. | |

FOREIGN PATENT DOCUMENTS

| | | | | |
|---|---|---|---|---|
| DE | 100 20 822 | | 11/2001 | |
| DE | 10 2005 032 839 | | 4/2007 | |
| DE | 10 2006 020 813 | | 10/2007 | |
| DE | 102006020813 | B3 * | 10/2007 | B01F 13/00 |
| DE | 102006020813 | B3 * | 10/2007 | B01F 15/00 |
| FR | 2686184 | A1 * | 7/1993 | G21C 15/12 |
| GB | 8 800 536.4 | | 4/1988 | |
| JP | 62-79839 | | 4/1987 | |
| JP | 62079839 | * | 4/1987 | B01F 15/06 |
| WO | 2004/073847 | | 9/2004 | |

* cited by examiner

CONTAINER WITH FLEXIBLE WALLS

BACKGROUND OF THE INVENTION

1. Field of the Invention

The invention relates to a container arrangement having a container with a flexible wall, in particular a disposable container which is insertable into a supporting container supporting the lateral container wall thereof, wherein the inner supporting surface of the supporting container, said supporting surface surrounding the lateral container wall, has at least one baffle forming the lateral container wall.

2. Description of the Related Art

Containers having flexible walls are increasingly used in particular as flexible disposable containers or mixing bags in the pharmaceutical/biotechnology industries where, in a very great variety of applications, sterile liquids not only have to be decanted, transported and stored but also manipulated under temperature control.

DE 10 2006 020 813 B3 discloses a container arrangement having a container with a flexible wall. The container arrangement has a cup-shaped supporting container in which a container having a flexible wall is insertable such that the lateral container wall thereof is supported by the supporting container. In this case, the inner supporting surface of the supporting container, which supporting surface provided the lateral container wall, has baffles which form the lateral container wall and assist the mixing process.

A drawback of the known container arrangement, which in principle has proven worthwhile, is that the temperature of the liquid medium placed into the container is regulated via the ambient or room temperature.

Furthermore, U.S. Pat. No. 6,837,610 B2 discloses a supporting container for a container having flexible walls, the supporting wall of which is designed as a heat exchanger with a temperature-regulating liquid.

A drawback in this case is that uniform, rapid thorough mixing is problematic without baffles and that, with baffles, uniform, rapid temperature regulation is problematic in particular in the baffle region. The pulsating baffle approach proposed in U.S. Pat. No. 6,837,610 B2 assists the thorough mixing but not the uniform, rapid temperature regulation.

Therefore, it is the object of the present invention to obtain uniform and rapid temperature regulation using baffles.

SUMMARY OF THE INVENTION

The invention relates to a container arrangement with a container having a flexible wall. The container with the flexible wall is insertable into a supporting container so that a supporting surface of the supporting container surrounds and supports a lateral wall of the container. At least one baffle has a temperature-regulating system.

The arrangement of the temperature-regulating system in the baffle firstly increases the surface area and secondly improves the transfer of heat by producing small eddies in a region of the flexible container which surrounds the baffle. The temperature-regulating system permits both heating and cooling of the liquid medium arranged in the flexible container. In this respect, the temperature-regulating system is suitable in particular for maintaining a preset temperature of the liquid medium arranged in the flexible container. "Metabolic processes" in the liquid medium can be stopped or at least delayed by rapid cooling. Regulation of a "flow temperature" of the temperature-regulating medium prevents overheating, and precise and consistent regulation can be obtained.

According to a preferred embodiment of the invention, a plurality of baffles having a temperature-regulating system are arranged on the inner supporting surface. Even if in principle a multiplicity of baffles is possible, four baffles, in particular, have proven successful for uniform temperature regulation.

According to another preferred embodiment of the invention, the temperature-regulating system of the baffles has tubes which are in each case parallel and through which a temperature-regulating liquid having a predefinable temperature can be conducted.

The baffle preferably has more tubes toward the supporting container than toward the lateral container wall. For example, the baffle has three tubes in a first row toward the supporting container, two tubes in a second row toward the lateral container wall and one tube in a third row. As a result, the baffle forms a cross section which is approximately triangular in the horizontal direction and has a favorable effect on the action by swirling the medium to be mixed and has a favorable effect with regard to uniform and rapid temperature regulation. Tubes which are adjacent to tubes conducting temperature-regulating liquid laterally and toward the liquid medium can be omitted or—if they are required for stability—can be arranged without any connections. In order, in the case of a series connection of the parallel tubes arranged vertically, to be able to arrange both the inflow and outflow at the top in the vertical direction, an even number of tubes is necessary.

The use of a temperature-regulating liquid enables the liquid medium contained in the container to be heated, cooled or kept constant relatively simply and rapidly.

In principle, however, it is also possible to use "Peltier elements", i.e. electrothermal transducers based on the Peltier effect, which can both heat and cool, for the temperature-regulating system.

According to another preferred embodiment of the invention, the parallel tubes of the temperature-regulating system or of the baffle in each case form a nest of tubes, the tubes of which are preferably connected to one another in a series connection. The series connection ensures a uniform supply of the temperature-regulating liquid. In particular, the series connection should be configured more simply if both the inflow and outflow are to be arranged at the upper end in order, for example, to be able to insert the baffles having the temperature-regulating system into the supporting container from above. Equally, the individual tubes or nests of tubes may also be connected in parallel. The design in the form of a nest of tubes results in a relatively stable baffle which is insertable into the supporting container from above.

If the tubes are formed from metal, said tubes may be, for example, soldered or welded to one another to form a nest of tubes. If the tubes are formed from plastic, said tubes may be adhesively bonded to one another to form a nest of tubes, or embedded in a casting compound.

According to another preferred embodiment of the invention, the temperature-regulating system is formed by two vertical plates which are arranged at an acute angle to each other and through which the temperature-regulating liquid can flow. In this case, the temperature-regulating liquid is supplied to the first plate via an inflow which is at the top in the vertical direction, is supplied to the second plate via a connecting part arranged at the bottom in the vertical direction, and is removed from the second plate via an outflow which is at the top in the vertical direction.

According to another preferred embodiment of the invention, the baffles are arranged interchangeably on the inner supporting surface of the supporting container. In this case, the baffles are interchangeable individually. However, they may also be connected to one another to form an interchangeable insert. The baffles having the temperature-regulating system are insertable into the supporting container from above in the vertical direction. If the inflows and outflows are arranged at the top, apertures in the wall of the supporting container may be dispensed with.

However, it is also possible, via corresponding openings or apertures in the side wall, to arrange inflows at the top in the vertical direction and outflows at the bottom in the vertical direction, or vice versa.

According to another preferred embodiment of the invention, the temperature-regulating systems of the baffles are connected via at least one supply line and a return line in a circuit to a temperature-regulating device in which the temperature of the temperature-regulating liquid can be regulated. Of course, the temperature-regulating device may also be controlled as a function of the measuring signals of a temperature sensor arranged on the flexible container.

Further details of the invention emerge from the detailed description below and the attached drawings in which preferred embodiments of the invention are illustrated by way of example.

DETAILED DESCRIPTION OF THE PREFERRED EMBODIMENTS

Figure 1:
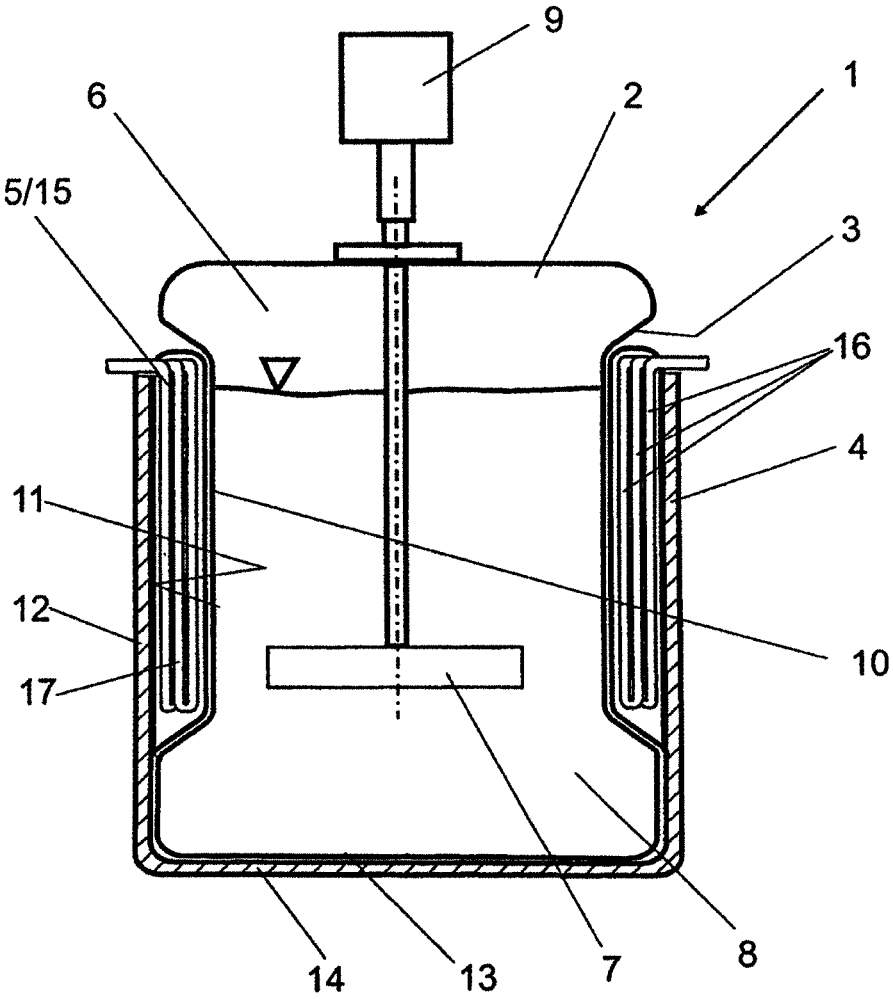
FIG. 1 shows a side view, partially in section, of a container arrangement having a container with a flexible wall and a supporting container with baffles (illustrated unsectioned).

A container arrangement 1 essentially comprises a container 2, such as a disposable container, with a flexible container wall 3 and a supporting container 4 with baffles 5.

The container 2 with the flexible container wall 3 has a container interior 6 in which a mixer 7 is arranged. Furthermore, a liquid medium 8 which is to be mixed is placed in the container interior 6. Connections for media to be supplied or conducted away or possible sensors are not illustrated. A drive 9 for the mixer 7 is arranged outside the container 2.

The container 2 is inserted into the supporting container 4 at least for the mixing process. In this case, the container 2 bears with the lateral container wall 10 thereof against an inner supporting surface 11 of a lateral supporting container wall 12. The container base 13 of the container 2 rests on a supporting container base 14 of the supporting container 4. In the exemplary embodiment according to FIG. 2, four baffles 5 forming the lateral container wall 10 are arranged on the inner supporting surface 11.

Figure 3:
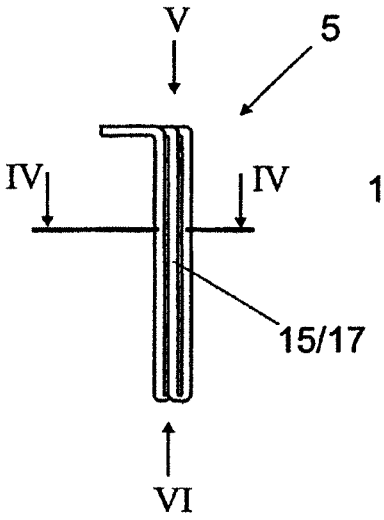
FIG. 3 shows a side view of a baffle from FIG. 1.
Figure 4:
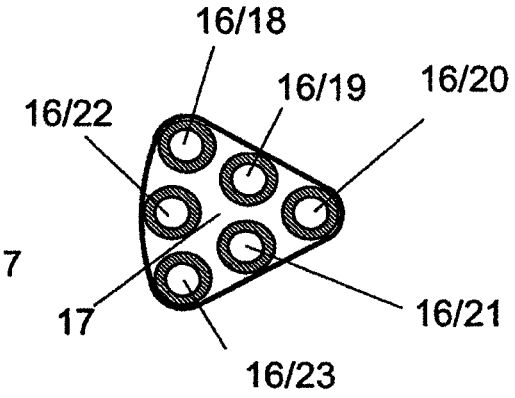
FIG. 4 shows a top view of the baffle from FIG. 3 sectioned along the line IV-IV.
Figure 5:
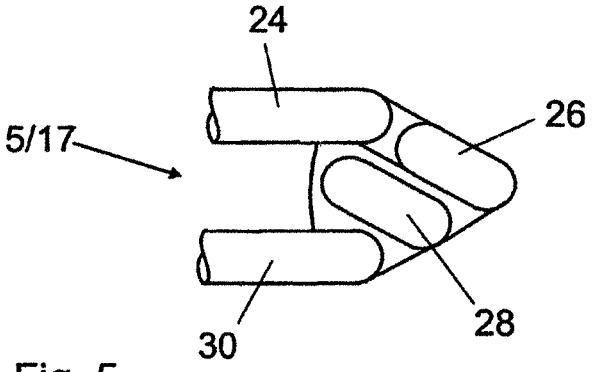
FIG. 5 shows a top view of the baffle from FIG. 3 from the direction V.
Figure 6:
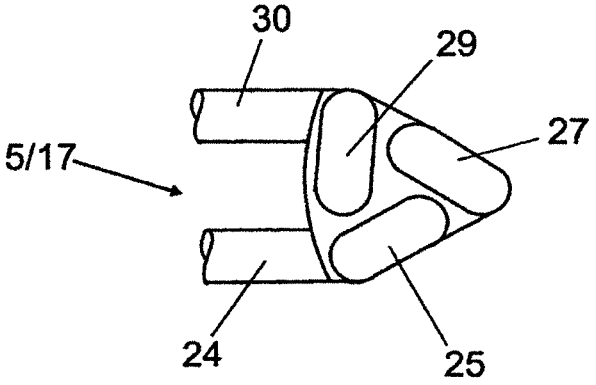
FIG. 6 shows a bottom view under the baffle from FIG. 3 from the direction VI.

The baffles 5 have a temperature-regulating system 15. The baffle 5 corresponding to the exemplary embodiment of FIG. 3 has parallel tubes 16, which are connected to one another to form a nest of tubes 17, as the temperature-regulating system 15. The nest of tubes 17 has six tubes 18, 19, 20, 21, 22, 23. The first tube 18 is connected at the top in the vertical direction to an inflow 24 and at the bottom in the vertical direction via a lower connecting tube 25 to the second tube 19. The second tube 19 is connected at the top in the vertical direction via an upper connecting tube 26 to the third tube 20. The third tube 20 is connected at the lower end thereof via a lower connecting tube 27 to the fourth tube 21. The fourth tube 21 is connected at the upper end thereof via an upper connecting tube 28 to the fifth tube 22. The fifth tube 22, for its part, is connected at the lower end thereof via a lower connecting tube 29 to the sixth tube 23 which, for its part, is connected at the upper end thereof to an outflow 30. The tubes 16 of the temperature-regulating system 15 and of the nest of tubes 17 are therefore connected in series. The nest of tubes 17 has the tubes 18, 22 and 23 in a first row toward the supporting container 4 or the lateral supporting container wall 12 thereof, two tubes 19, 21 in a second row toward the lateral container wall 10 and the tube 20 in a third row. The nest of tubes 17 therefore forms an approximately triangular cross section which is shaped convexly in the base thereof and is matched to the inside diameter of the lateral supporting container wall 12.

Figure 7:
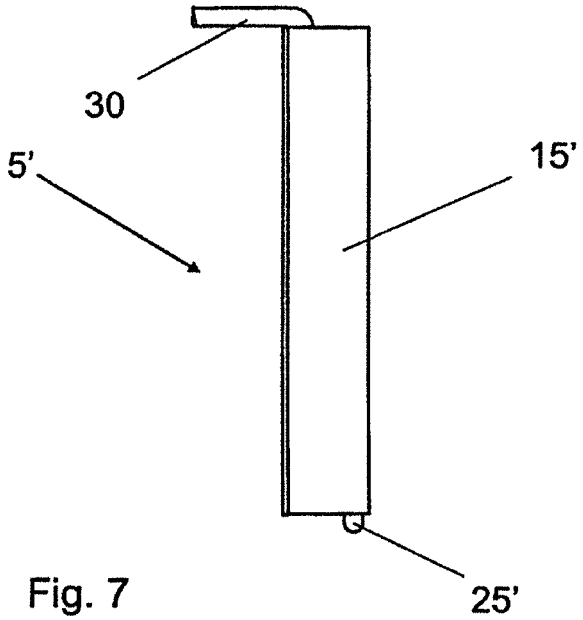
FIG. 7 shows a side view of a further baffle having a temperature-regulating system comprising two plates arranged at an acute angle.
Figure 8:
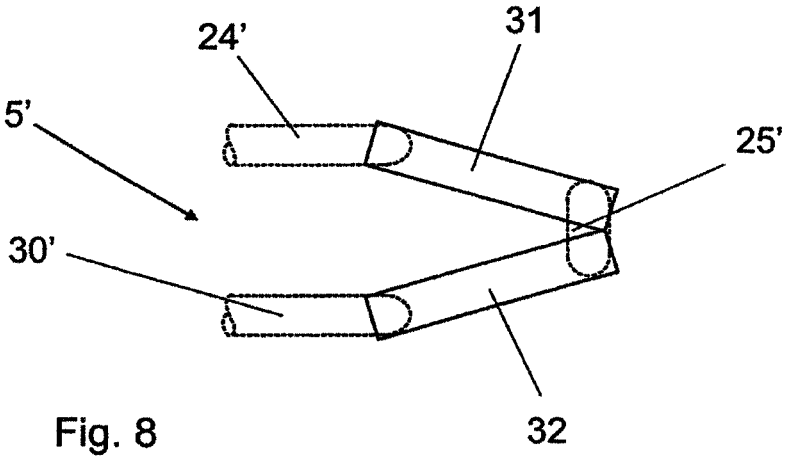
FIG. 8 shows a top view of the baffle from FIG. 7 with an inflow and outflow indicated by broken lines, and a connecting line indicated by broken lines.

According to the exemplary embodiment of FIGS. 7 and 8, the temperature-regulating system 15' of the baffle 5' has two vertical plates 31, 32 which are arranged at an acute angle to each other and through which the temperature-regulating liquid flows. For this purpose, the first vertical plate 31 is connected at the upper end thereof to the inflow 24' and at the lower end thereof via a lower connecting tube 25' to the second vertical plate 32 which, for its part, is connected at the upper end thereof to the outflow 30'. The baffles 5, 5' are interchangeable individually.

Figure 9:
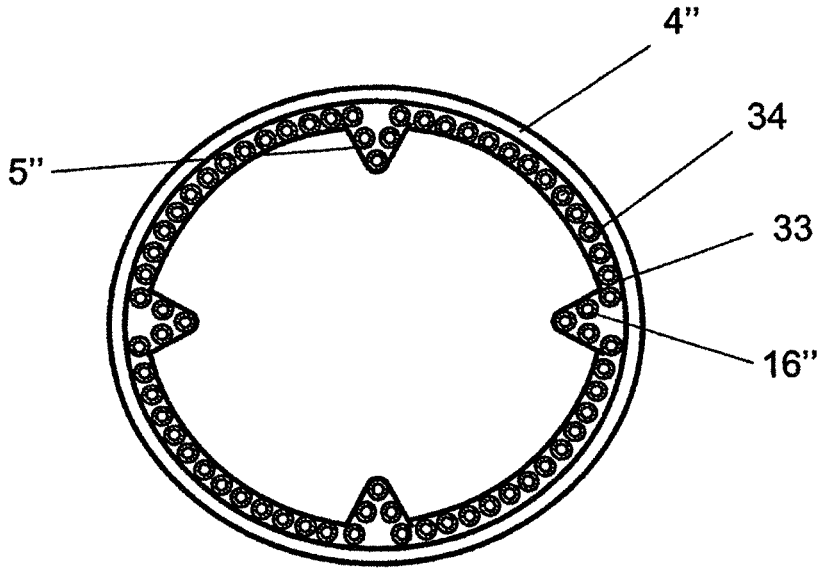
FIG. 9 shows a top view in section of an insert comprising baffles connected via tubes.

According to the exemplary embodiment of FIG. 9, the baffles 5" and the tubes 16" thereof are connected to one another via further tubes 34. In this case, the tubes 34 are connected in series to the tubes 16". The interchangeable insert 33 is also insertable into the supporting container 4" from above.

Figure 2:
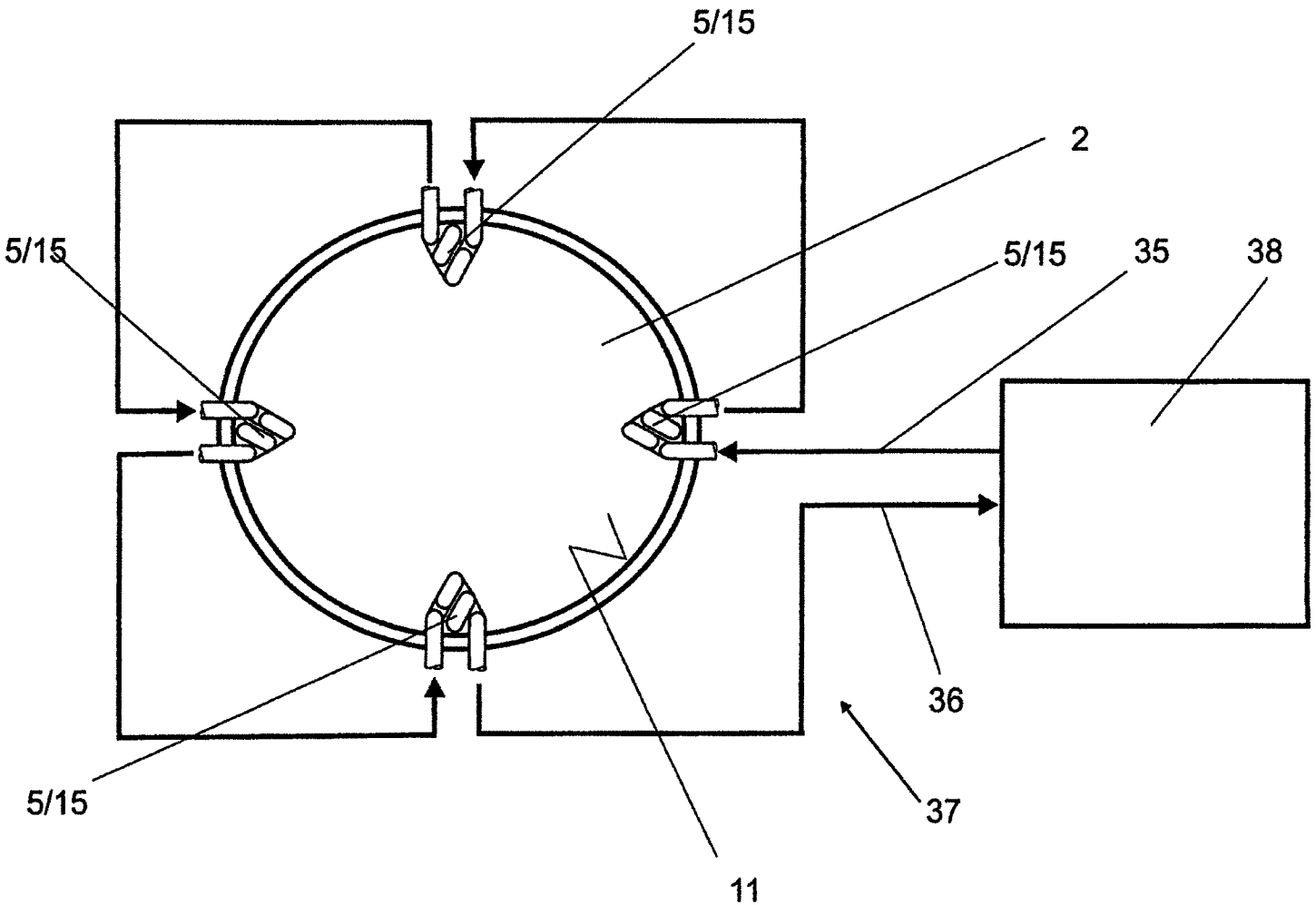
FIG. 2 shows a top view of a supporting container with four baffles having a temperature-regulating system and a temperature-regulating device.

According to the exemplary embodiment of FIG. 2, the temperature-regulating systems 15 of the baffles 5 are connected via a supply line 35 and a return line 36 in a circuit 37 to a temperature-regulating device 38 in which the temperature of the temperature-regulating liquid is regulated.

The invention claimed is:

1. A container arrangement comprising: a container with a flexible lateral wall, the container being insertable into a supporting container so that an inner supporting surface of the supporting container is in supporting and surrounding relationship with the lateral wall of the container, a plurality of circumferentially spaced baffles between the inner supporting surface of the supporting container and the flexible lateral wall of the container so that the baffles shape the flexible lateral wall of the container, the baffles having a temperature-regulating system that comprises parallel tubes through which a temperature-regulating liquid flows, the tubes being interconnected to one another to form a replaceable insert, the tubes of each of the baffles are arranged so that three tubes are in a first row toward the supporting container, two tubes are arranged in a second row toward the lateral container wall and one tube is arranged in a third row toward the lateral container wall.

2. The container arrangement of claim 1, wherein said tubes parallel form a nest of tubes.

3. The container arrangement of claim 2, wherein the tubes of the baffles are connected to form a series connection with an inflow and an outflow.

4. The container arrangement of claim 1, wherein the connected baffles having the temperature-regulating system are insertable into the supporting container from above.

5. The container arrangement of claim 1, wherein the temperature-regulating systems of the baffles are connected to at least one supply line and a return line in a circuit to a temperature-regulating device in which the temperature of the temperature-regulating liquid can be regulated.

6. The container arrangement of claim 1, wherein the insert comprises an inflow and outflow for the temperature-regulating liquid.

7. An arrangement comprising: a supporting container comprising a lateral supporting container wall with an inner supporting surface; an inner flexible container comprising a flexible lateral container wall; an array of spaced apart baffles between the flexible lateral container wall and said supporting container so that the baffles shape the flexible lateral container wall, the baffles being connected to one another to form a replaceable insert that is insertable into the supporting container from above; and a temperature-regulating system incorporated into the baffles of the replaceable insert, the temperature regulating system comprises parallel tubes through which a temperature-regulating liquid flows, the tubes of the baffles are arranged so that three tubes are in a first row toward the supporting container, two tubes are arranged in a second row toward the lateral container wall and one tube is arranged in a third row toward the lateral container wall.

8. An arrangement comprising: the arrangement of claim 7, the temperature-regulating system comprises: a supply side and a return side, whereby a temperature regulating liquid or gas flows through said tubes in the supply side and out the return side.

9. The arrangement of claim 8, wherein said temperature-regulating system comprises a peltier element.

10. The arrangement of claim 7, wherein said inner flexible container is disposable.

* * * * *